US007213531B2

(12) United States Patent
Ahern

(10) Patent No.: US 7,213,531 B2
(45) Date of Patent: May 8, 2007

(54) MULTIDIRECTIONAL FLOATING DOCK ELEMENT

(76) Inventor: Roy Ahern, 1120 Front St., Hudson, WI (US) 54016

( * ) Notice: Subject to any disclaimer, the term of this patent is extended or adjusted under 35 U.S.C. 154(b) by 372 days.

(21) Appl. No.: 10/779,477

(22) Filed: Feb. 12, 2004

(65) Prior Publication Data

US 2005/0204989 A1 Sep. 22, 2005

(51) Int. Cl.
*B63B 35/44* (2006.01)

(52) U.S. Cl. ..... 114/263; 114/266; 114/267

(58) Field of Classification Search ..... 114/44–48, 114/263, 264, 266; 405/4–7, 218–220; D12/316
See application file for complete search history.

(56) References Cited

U.S. PATENT DOCUMENTS

| | | | | |
|---|---|---|---|---|
| 3,824,644 | A | 7/1974 | Stranzinger | |
| 4,604,962 | A | 8/1986 | Guibault | |
| 5,183,001 | A * | 2/1993 | Stranzinger | 114/266 |
| 5,251,560 | A * | 10/1993 | Ban et al. | 114/266 |
| 5,529,013 | A | 6/1996 | Eva, III et al. | |
| 5,682,833 | A | 11/1997 | Eva, III et al. | |
| 5,690,523 | A * | 11/1997 | Yu | 441/35 |
| 5,931,113 | A * | 8/1999 | Eva et al. | 114/263 |
| 5,941,660 | A | 8/1999 | Rueckert | |
| 5,947,049 | A | 9/1999 | Elson | |
| 5,947,050 | A | 9/1999 | Eva, III et al. | |
| 6,006,687 | A * | 12/1999 | Hillman et al. | 114/46 |
| 6,033,151 | A | 3/2000 | Tsou | |
| 6,138,599 | A | 10/2000 | Elson | |
| 6,199,502 | B1 * | 3/2001 | Mattson | 114/266 |
| 6,431,106 | B1 | 8/2002 | Eva, III et al. | |
| 6,526,902 | B1 * | 3/2003 | Faber | 114/263 |
| 6,745,714 | B1 * | 6/2004 | Faber | 114/263 |
| D508,453 | S * | 8/2005 | Ahern | D12/317 |

* cited by examiner

*Primary Examiner*—Ajay Vasudeva
(74) *Attorney, Agent, or Firm*—McHale & Slavin PA

(57) ABSTRACT

The present invention relates to a multidirectional floating element. The multidirectional floating element is preferably a polyhedron in overall shape including a first generally planar surface adapted for use a deck, a second surface having a V-shaped channel adapted for receiving and guiding a watercraft keel and a plurality of side walls for adjoining and maintaining spacing between the first surface and the second surface.

31 Claims, 5 Drawing Sheets

MULTIDIRECTIONAL FLOATING DOCK ELEMENT

FIELD OF THE INVENTION

This invention is directed to floating docks and, in particular, to an multidirectional floating dock element especially suited for assembly of floating docks, drive-on docks and floating decks.

BACKGROUND OF THE INVENTION

In the past modular floating docks have been created by the assembly of a number of floating subunits. These subunits include various geometric shapes with planar upper and lower surfaces. The subunits connect together to create docks and walkways having various shapes and sizes based on the consumers needs.

For example, U.S. Pat. Nos. 6,138,599 and 5,947,049 teach a buoyant walkway module for a boatlift. The device includes a plurality of elongated compartments having planar top and bottom surfaces. The device also includes planar ends for connecting the walkways together in an end to end relationship.

U.S. Pat. No. 5,251,560 teaches a water-float coupling device for coupling together hexagonally shaped floats having planar upper and lower surfaces.

U.S. Pat. No. 6,033,151 teaches a float unit having planar upper and lower surfaces and corrugated side surfaces. The corrugated side surfaces engage with adjacent floats to provide friction between the units.

U.S. Pat. Nos. 3,824,644 and 4,604,962 teach a substantially prismatic, floating element having rounded corner edges. The elements are provided with outwardly projecting eye lugs for attachment to adjacent elements. These elements are typically provided with bungholes to allow partial flooding of some or all of the units to lower their water line.

It is also known in the prior art to construct floating drive-on type docks. The docks are assembled from floating elements having various geometric shapes to create a dock which allows a boat operator to drive his/her boat directly onto the upper surface of the dock using the boats power.

For example, U.S. Pat. No. 5,941,660 teaches a watercraft support structure formed from a plurality of large rigid platforms that are coupled together by linking pins or insertion plugs. The structure includes multiple ramp, cradle, and flat platforms.

These devices work relatively well for docking large watercraft however, the upwardly extending hull guides and cylindrically shaped upper surface make these devices generally unsuitable for dual use as decks or walkways.

Other floating drive-on docks of the prior art are constructed of cubical subunits with tabs projecting from the vertical edges at or near the horizontal midline for attachment to adjacent units. The units have planar upper surface and lower surfaces. The floating units are provided with a gripping texture on one side and thus, are generally designed to be oriented only with the gripping surface upward.

For example, U.S. Pat. Nos. 5,529,013, 5,682,833, 5,947,050, 6,431,106 and 5,931,113 teach a floating drive-on dock assembled using the parallelepiped shaped units. The docks generally consist of two arms (single rows) of hollow and airtight floatation units. The arms each consist of three large cubes at the inward portion and three small cubes mounted at the distal end. Between the arms is an area open to the water surface. At the distal end of the two arms a floatation unit is utilized to connect the arms together to prevent the arms from spreading apart as a craft is driven onto the arms.

While these designs are functional, they have numerous shortcomings that have not been addressed in the art. For example, in order to provide guidance for the boat hull when used for drive-on docking, the planer surfaced cubes must be spaced apart leaving an open center between the two arms. The open center does not provide sufficient guiding for several types of boat hulls.

In addition, the narrow width of the arms, the lack of connection to floatation units on four sides, the open center, and the low buoyancy of the small cubes make these structures extremely unstable for pedestrian traffic and unsuitable for decks or walkways. This safety hazard is magnified when the docks are used at night.

Still further, the open nature of these docks combined with the wave action associated with large bodies of water often results in repeated splashing of water into the drive units of the docked watercraft and thus causes premature failure of important components of the watercraft drive system. Keeping a watercraft high and dry when not in use is important to protecting the machinery of the craft. This is particularly true of jet type propulsion systems and is critical when the craft is docked in salt water.

Thus, what is needed in the art is a modular docking element that is adapted for assembly into walkways, decks and drive-on docks to provide increased versatility and safety. The element should be multidirectional, having a surface specific to drive-on docking on one face and a surface specific to decks and walkways on a second face. Each of these faces should provide a surface which allows a watercraft to slide easily for drive-on docking without hull damage, while providing superior grip for pedestrian traffic. The floating element should also accommodate utilities, e.g. water and electricity throughout the dock and/or walkway when assembled. The assembled floating elements should also accommodate rigid members wherever they are needed throughout the dock to change the flex and buoyancy characteristics of the dock. Each individual floating element should optionally allow ballast to be added to alter the height, buoyancy and stability of an assembled dock or walkway.

SUMMARY OF THE INVENTION

The present invention provides a multidirectional floating element. The multidirectional floating element is preferably a polyhedron in overall shape including a first generally planar surface adapted for use as a deck, a second surface having a V-shaped channel adapted for receiving and guiding a watercraft hull, and a plurality of side walls for adjoining and maintaining spacing between the first surface and the second surface. The V-shaped channel extends across the center portion of the element and preferably includes two generally parallel and planar surfaces spaced apart and connected by a generally planar lower surface. The two generally parallel and planar surfaces diverge outwardly at predetermined angles to cooperate with a boat keel when used for drive-on docking.

The first surface, second surface and the plurality of side walls are formed of polymeric material(s) by conventional methods well known in the art. Using these methods, the first surface, second surface and side walls may be formed continuous or they may include at least one aperture therethrough. In the preferred embodiment the aperture is con structed and arranged to allow the buoyancy of the floatation element to be altered by the addition of ballast. Cooperating with the aperture is one of a variety of caps or plugs. The cap may be constructed and arranged to maintain air tightness within the floatation element or the cap may be adapted to include a vent, allowing air and/or water to flow inwardly and outwardly from within the floatation element upon a predetermined pressure.

The floatation element also includes connection means adapted for linking adjacent flotation elements together. The connection means may be arranged so that the uppermost surfaces of the adjacent floatation elements are substantially coplanar, or so that the uppermost surfaces of adjacent floatation elements are vertically offset and generally parallel to create an upper surface and a lower surface.

Preferably the connection means include a plurality of horizontally projecting tabs, each including at least one aperture therethrough. The aperture is constructed and arranged to cooperate with at least one horizontally projecting tab of an adjacent flotation element. In a most preferred embodiment the horizontally projecting tabs extend generally from intersecting corners of the side walls at different vertical levels for overlapping cooperation with horizontally projecting tabs of adjacent floatation elements while maintaining a planer upper surface. In alternative embodiments the horizontally projecting tabs may be offset closer to the first surface or the second surface to permit offset and generally parallel upper surfaces and lower surfaces with respect to adjacent floatation elements.

In alternative embodiments the floatation elements may be formed in various other polyhedral shapes that are adapted to fit together suitably for use as floating walkways, docks or decks. Some of these shapes may include, but should not be limited to rectangles, squares, pentagons, hexagons, octagons and the like.

In other alternative embodiments at least one, and preferably two, of the side walls include an integrally formed semi-circular conduit extending the length of the floatation element; the semi-circular conduit being constructed and arranged to cooperate with semi-circular conduits of adjacent floatation elements to create a generally circular conduit extending through assembled decks, walkways or docks. The conduit is adapted for providing a pathway for service utilities throughout adjacent assembled floatation elements. In this manner service utilities such as electricity and water may be utilized throughout the assembled floatation elements. The circular conduit may also be utilized for insertion of rigid or semi-rigid members for altering the flex and buoyancy characteristics of the assembled floatation elements.

Thus, it is an objective of the instant invention to provide a modular multidirectional floating element for use in assembling walkways, decks and docks.

Another objective of the instant invention is to provide a multidirectional floating element having a first planar surface, a second watercraft keel guiding surface and a plurality of sidewalls that are continuously formed.

A further objective of the instant invention is to provide a vented multidirectional floating element having a first planar surface, a second watercraft keel guiding surface and a plurality of sidewalls.

An additional objective of the instant invention is to provide a multidirectional floating element which can be assembled into a deck-like drive-on dock assembly that provides increased safety by not requiring open wells or gaps between floatation elements for drive-on operation.

Yet another objective of the instant invention is to provide a multidirectional floating element which can be assembled into a floating dock or walkway assembly having a utility conduit.

Still another objective of the instant invention is to provide a multidirectional floating element which can be assembled into a floating dock assembly having a conduit for stiffening members.

Still yet another objective of the instant invention is to provide a multidirectional floatation element having a planer surface that can be utilized for decks and walkways and a contoured surface which can be utilized for guiding the keel of a watercraft onto a drive-on dock assembly.

Still yet another objective of the instant invention is to provide a kit for use with pre-existing drive-on dock structures for increasing the safety thereof.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Figure 1:
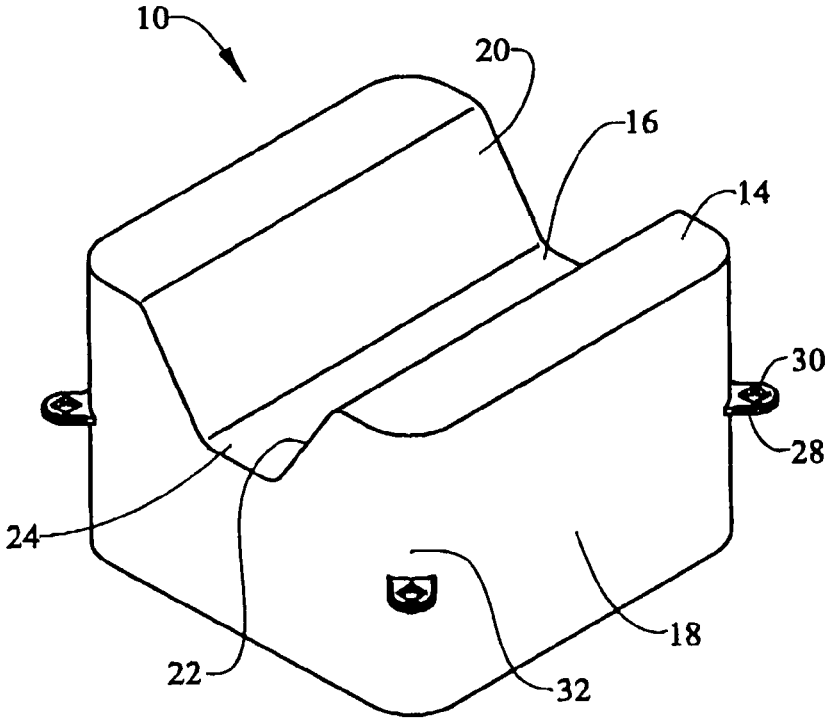
FIG. 1 is a pictorial view showing the watercraft guiding surface of the instant invention.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

Figure 2:
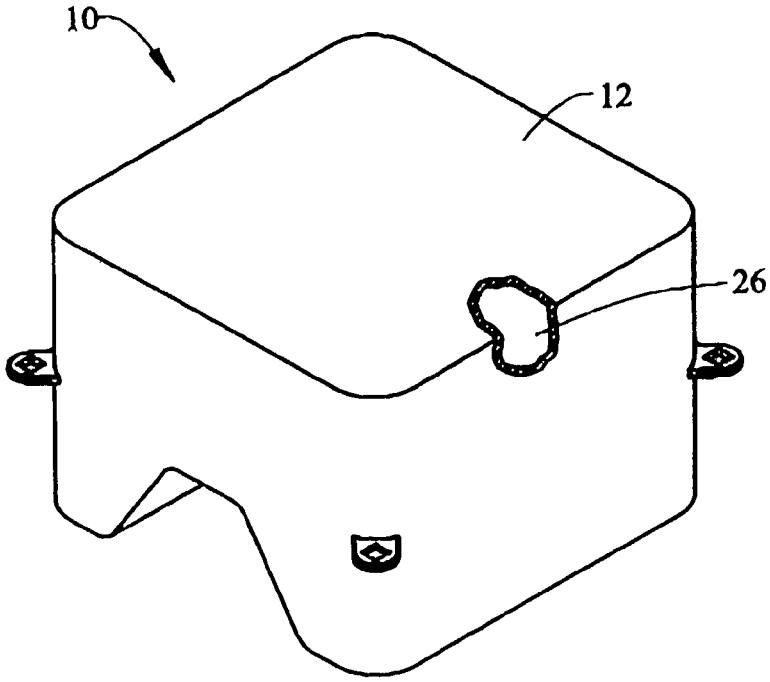
FIG. 2 is a pictorial view, partially in section, showing the planer surface of the instant invention as well as the internal cavity.

With reference to FIGS. 1 and 2, the instant invention provides a multidirectional floating element 10. The floating element 10 in its preferred embodiment is a polyhedron in overall shape, including a first generally planar surface 12, a second guiding surface 14 having a V-shaped channel 16 and a plurality of side walls 18 for adjoining and maintaining spacing between the first surface and the second surface. In operation, the first surface 12 is generally arranged to face upwardly for use in constructing floating walkways, floating decks and the like. The second surface 14 is generally arranged to face upwardly for use in constructing a portion of a drive-on dock assembly to provide precise guiding to the keel portion of a watercraft. The guiding surface is illustrated herein in a non-limiting embodiment as a V-shaped channel 16 extending across the center portion of the floatation element 10 including two generally parallel and planar surfaces 20, 22 spaced apart and connected by a generally planar lower surface 24. The two generally parallel and planar surfaces diverge outwardly at predetermined angles to cooperate with a boat keel for use in drive-on docking. In this manner a precise guiding surface is provided for boats having a variety of hull shapes. It should also be appreciated that other contoured surface shapes may be employed without departing from the scope of the instant invention. The multidirectional floatation elements may be formed in various sizes to provide the needed buoyancy for various applications. In the preferred embodiment the multidirectional floatation elements are about 19 inches across when viewed from the top and between about 6 inches and 30 inches in height when viewed from the side.

Figure 3:
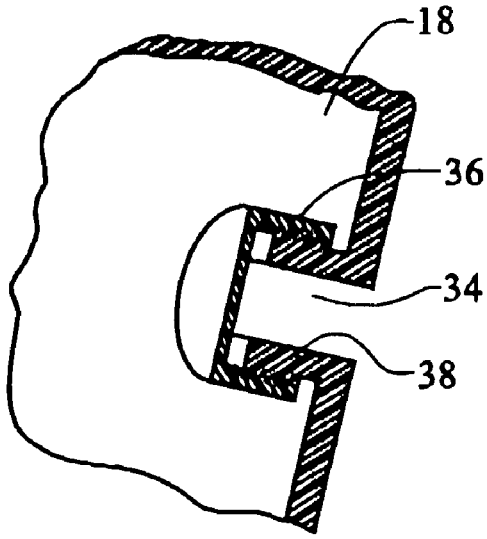
FIG. 3 is a partial section view illustrating the aperture and cap arrangement for venting and ballast control of the instant invention.

Referring to FIGS. 1 through 3, the first surface 12, second surface 14 and the plurality of side walls 18 are formed of polymeric material(s) by conventional methods well known in the art, e.g. blow molding, roto-molding, injection molding and the like. Using these methods the first surface 12, second surface 14 and side walls 18 may be formed continuous or they may include at least one aperture 34 therethrough. In the preferred embodiment the aperture 34 includes a tubular stem 38 constructed and arranged to allow the buoyancy of the floatation element to be altered by the addition of ballast, e.g. water, sand, metal shot and the like to the internal cavity 26 of the floatation element. Cooperating with the aperture 34 is one of a variety of caps 36. The cap 34 may be constructed and arranged for threaded engagement with the tubular stem 38 to maintain air tightness within the floatation element 10 or the cap 34 may be adapted to include a vent (not shown), allowing air and/or water to flow inwardly and outwardly from within the floatation element internal cavity 26 upon a predetermined pressure.

Figure 4:
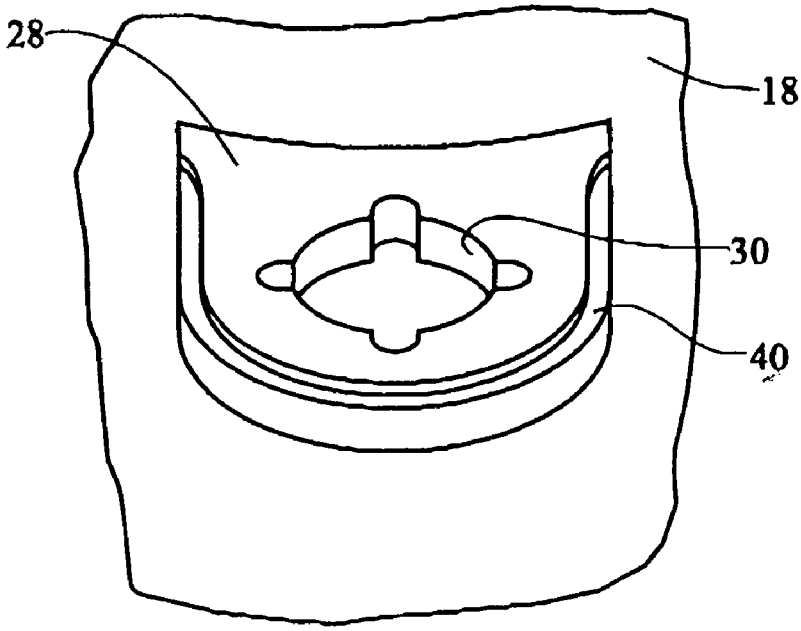
FIG. 4 is a partial pictorial view of the connection means utilized in the instant invention.

Referring to FIG. 4, the floatation element 10 also includes connection means illustrated herein as a plurality of horizontally projecting tabs 28 each including at least one fastening aperture 30. The tabs 28 are preferably arranged to extend generally from intersecting corners 32 (FIG. 1) of the side walls 18 at different vertical levels between the first and second surfaces for overlapping cooperation with horizontally projecting tabs of adjacent floatation elements, so that the uppermost surfaces of adjacent floatation elements are substantially coplanar. Alternatively, the tabs 28 may be offset closer to the first surface or the second surface, so that the uppermost surfaces of adjacent floatation elements are vertically offset and generally parallel (FIG. 7) with respect to each other for a stepped configuration having an upper surface 46 and a lower surface 48. In this manner assemblies such as stairs and watercraft hull supports may be created. In addition, this construction may be utilized to vary the flexing characteristics of assemblies constructed from the floatation elements.

Still referring to FIG. 4, the tabs are also preferably constructed to include a tongue member 40 along the perimeter of the tabs 28. The tongue member 40 is constructed and arranged to cooperate with fastener components having a cooperating groove attached thereto, such as threaded nuts or bayonet receivers and the like, to hold the components in place during assembly of floatation elements. In this manner the fastening components may be slid over the tongue portion of the tabs to secure the component in place and prevent rotation thereof during assembly. The fastening aperture 30 is constructed and arranged to align with at least one fastening aperture of an adjacent flotation element for assembly. Fasteners well known in the art, e.g. threaded or bayonet type, may be inserted through the tab apertures for assembly.

Figure 5:
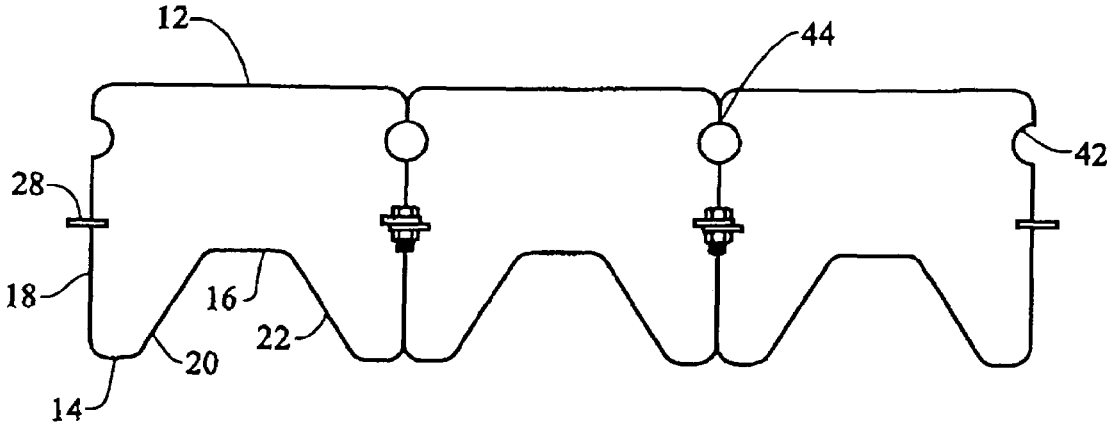
FIG. 5 is an end view illustrating one assembly embodiment of the instant invention.

Referring to FIG. 5, an assembly of three multidirectional floatation elements 10 having their first surface 12 uppermost are illustrated. In this embodiment each of the individual floatation elements 10 include at least one and preferably two integrally formed semi-circular conduits 42 extending the length of the floatation element 10 along the side walls 18. The semi-circular conduit is positioned to cooperate with semi-circular conduits of adjacent floatation elements to create a generally circular conduit 44 extending through the assembly. The circular conduit 44 is adapted for providing a pathway for service utilities throughout adjacent assembled floatation elements. In this manner service utilities such as electricity and water as well as conveniences such as fuel, compressed air or vacuum may be utilized throughout the assembled floatation elements. The conduits are preferably positioned along the sidewall evenly spaced between the first and the second surfaces allowing the conduits to be equally utilized regardless of the floatation element orientation. Alternatively, the conduits 42 may be positioned closer to the first surface 12 than to the second surface 14 or visa versa.

Figure 6:
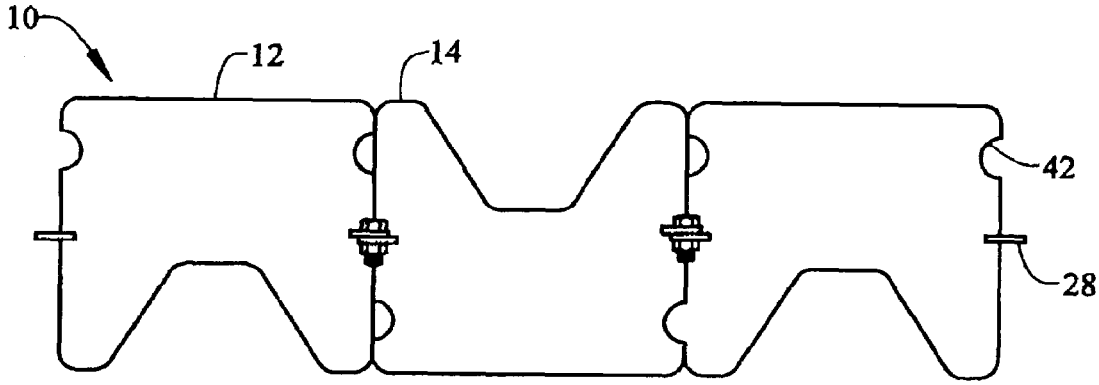
FIG. 6 is an end view illustrating one assembly embodiment of the instant invention.
Figure 7:
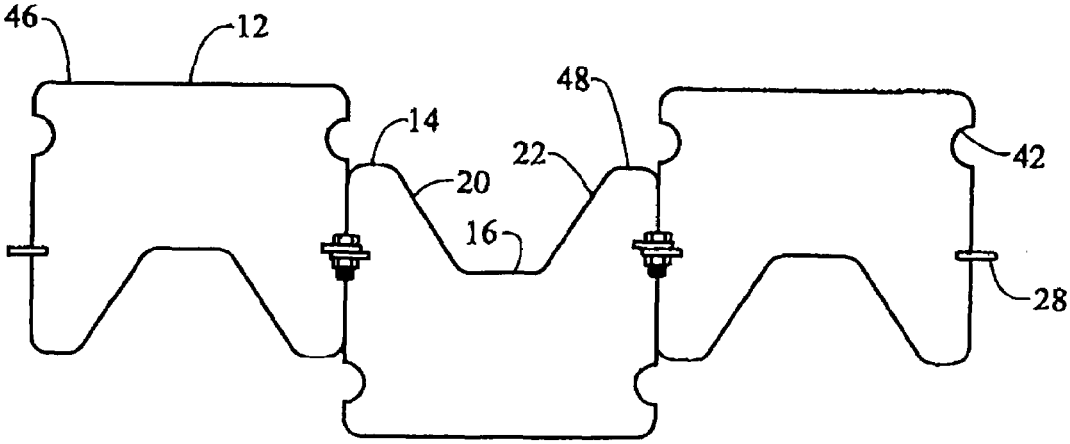
FIG. 7 is an end view illustrating one assembly embodiment of the instant invention.

Referring to FIGS. 6 and 7, an assembly of three multidirectional floatation elements 10 is illustrated, the outer elements having their first surface 12 uppermost and the center element having its second guiding surface uppermost. FIG. 6 illustrates the relative position of the adjacent uppermost surfaces when the tabs are positioned generally at the center portion of the sidewalls 18. FIG. 7 illustrates the relative position of adjacent uppermost surfaces when the tabs are positioned closer to the second surface 14 than to the first surface 12. It should be appreciated that because the tabs flex, varying the space between adjacent floatation elements or altering the tab 28 placement alters the flexing characteristics of the assembled floatation elements 10. In the preferred embodiment the tabs are about 4⅛ inches in length and about 5 inches below the first surface.

It should also be appreciated that the multidirectional floatation elements may be formed in various other polygonal shapes that are adapted to fit together suitably for use as floating walkways, docks or decks without departure from the scope of the invention. Some of these shapes may include, but should not be limited to rectangles, squares, pentagons, hexagons, octagons and the like.

Figure 8:
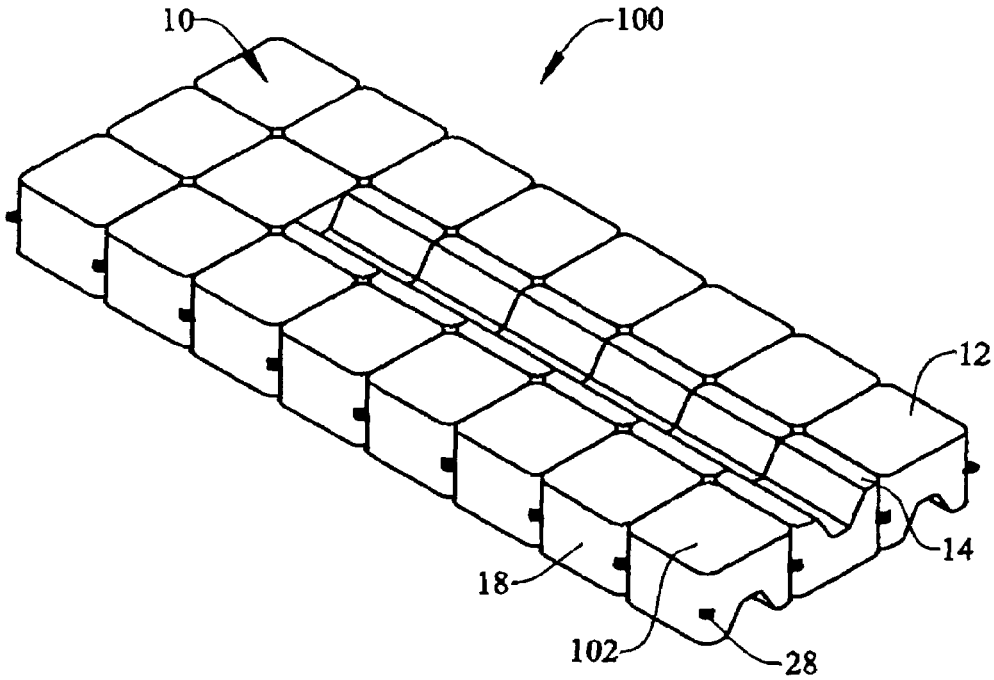
FIG. 8 is a pictorial view of a drive-on dock constructed using the multidirectional floatation elements of the instant invention.

Referring to FIG. 8, a floating drive-on dock 100 constructed from a plurality of multidirectional floatation elements 10 is illustrated. The tabs 28 are positioned on the sidewalls 18 of the floatation elements so that the uppermost surfaces form a generally planer surface with a V-shaped keel guide extending generally along the centerline of the drive-on dock. The drive-on dock is preferrably constructed of a plurality of multidirectional floatation elements 10 having the same general size with a portion of the floatation elements being positioned with their first surface 12 uppermost and a portion of the floatation elements positioned with the second surface 14 uppermost. In an alternative embodiment the floatation elements at the distal end 102 may be smaller in size or may include ballast to lower the profile of the distal end of the drive-on dock 100.

Figure 9:
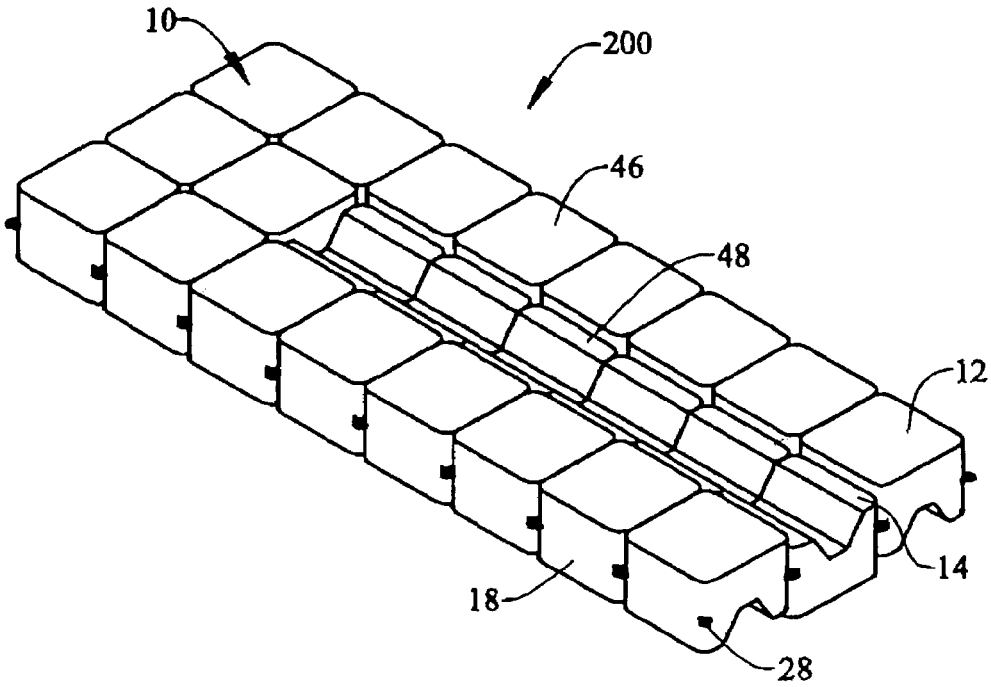
FIG. 9 is a pictorial view of a drive-on dock constructed using the multidirectional floatation elements of the instant invention.

Referring to FIG. 9, a floating drive on dock 200 constructed from a plurality of floatation elements 10 is illustrated. The tabs 28 are positioned on the sidewalls 18 of the floatation elements so that the uppermost surfaces 46 and 48 of the floatation elements 10 form stepped and generally parallel planer surfaces with a V-shaped keel guide extending generally along the centerline of the dock. The drive-on dock is preferably constructed of a plurality of floatation elements 10 having the same general size with a portion of the floatation elements being positioned with their first surface 12 uppermost and a portion of the floatation elements positioned with the second surface 14 uppermost. This construction is particularly suited for applications requiring additional buoyancy and reduced flexing between the floatation elements. In an alternative embodiment the floatation elements at the distal end 202 may be smaller in size or may include ballast to lower the profile of the distal end of the drive-on dock 200.

Figure 10:
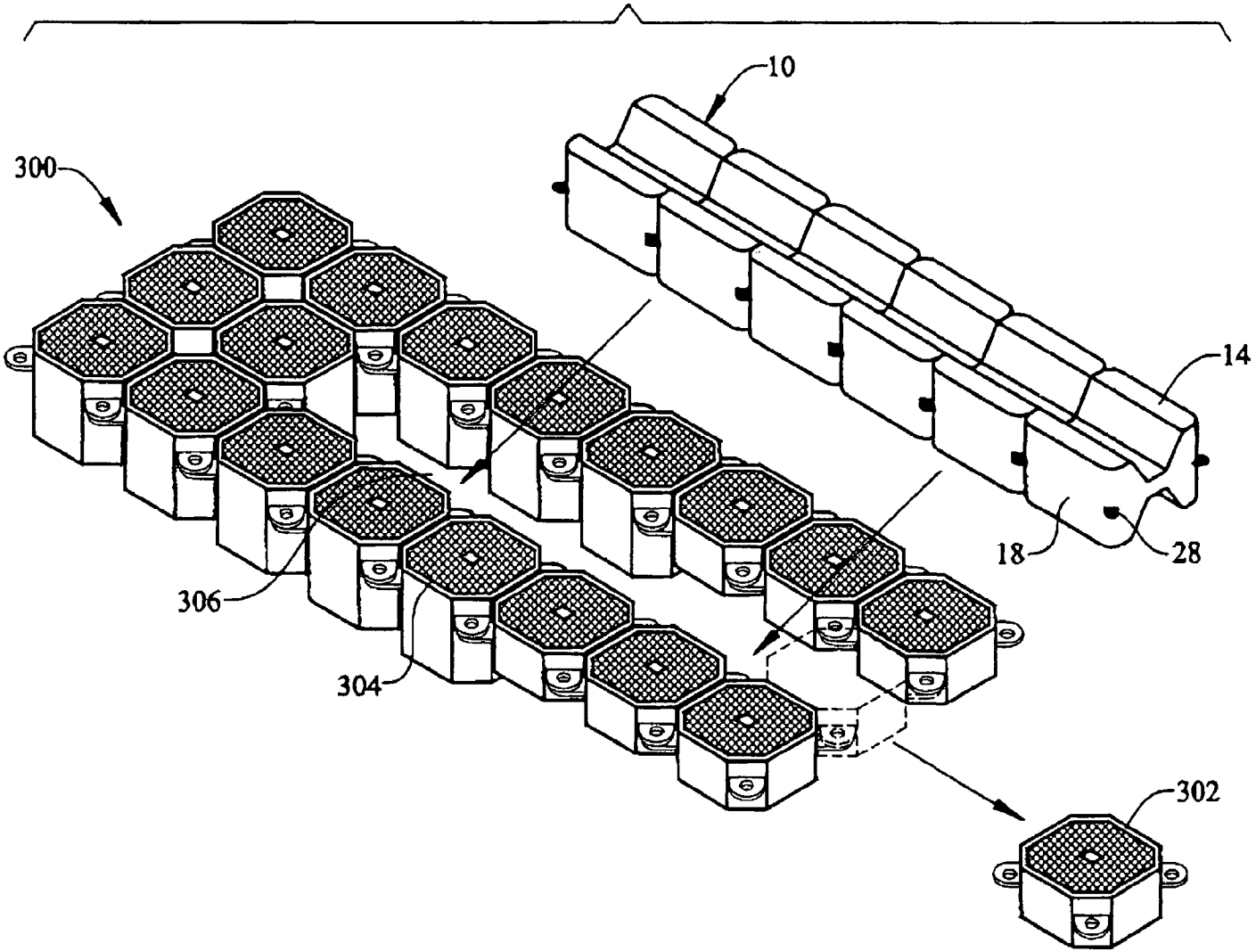
FIG. 10 is a pictorial view of the prior art and a pictorial view of a kit of the instant invention for filling in the open well of the prior art.

Referring to FIG. 10, a kit for filling the open well of the prior art drive on dry dock assembly 300 is illustrated. The kit includes at least one and preferably six multidirectional floatation elements 10. In operation, the connecting member 302 is removed from between the two extending arms 304 and the plurality of multidirectional floatation elements 10 are placed between the arms 304 and secured thereto using the tabs 28. The multidirectional floatation elements 10 are preferably positioned having their guiding surface uppermost. In this manner the open well 306 of the prior art is filled to provide a safer drive-on dock that can also be used as a deck or walkway. In addition, improved keel guiding and buoyancy is provided to boats being driven onto the dock.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A multidirectional floatation element useful for assembling decks, walkways and docks comprising:

a first generally planar surface, said first surface adapted for use as a deck;

a second surface, said second surface adapted for receiving and guiding a watercraft, wherein said second surface includes a V-shaped channel extending across a center portion of said multidirectional floatation element, said V-shaped channel including two generally parallel and planar surfaces, said two generally parallel and planar surfaces diverging outwardly to cooperate with a boat keel to provide a guiding surface therefor;

at least four side walls for adjoining and maintaining spacing between said first surface and said second surface, said side walls arranged to form a generally rectangular shape, wherein at least one of said side walls includes a semi-circular conduit extending the length thereof and positioned between said first and said second surfaces, whereby said semi-circular conduit is constructed and arranged to cooperate with semi-circular conduits of adjacent float elements to create a generally circular conduit extending through adjacent assembled floatation elements;

whereby said first surface, said second surface and said at least four side walls are continuous and cooperate to form a hollow multidirectional floatation element, whereby said multidirectional floatation element may be positioned having said first surface uppermost for constructing decks and walkways, whereby said multidirectional floatation element may be positioned having said second surface uppermost for constructing a watercraft keel guiding surface, whereby said multidirectional floatation elements are adapted for connection to adjacent multidirectional floatation elements.

2. The multidirectional floatation element according to claim 1, wherein said multidirectional floatation element includes an aperture through one of said plurality of side walls, said aperture constructed and arranged to allow the addition or subtraction of ballast;

whereby the buoyancy of said floatation element is altered by the addition or subtraction of said ballast.

3. The multidirectional floatation element according to claim 2, wherein said floatation element includes a plug constructed and arranged to cooperate with said aperture for maintaining air-tightness within said multidirectional floatation element.

4. The multidirectional floatation element according to claim 2, wherein said floatation element includes a vented plug constructed and arranged to cooperate with said aperture for allowing air to flow inwardly and outwardly from within said multidirectional floatation element upon a predetermined pressure.

5. The multidirectional floatation element according to claim 1, wherein said multidirectional floatation element includes connection means, said connection means adapted for linking to at least one adjacent multidirectional flotation element.

6. The multidirectional floatation element according to claim 5, wherein said connection means is constructed and arranged to link adjacent multidirectional floatation elements together so that the uppermost surfaces of adjacent floatation elements are substantially coplanar.

7. The multidirectional floatation element according to claim 5, wherein said connection means is constructed and arranged to link adjacent multidirectional floatation elements together so that the uppermost surfaces of adjacent floatation elements are vertically offset to create an upper surface and a lower surface, wherein said upper surface and said lower surface are about parallel with respect to each other.

8. The multidirectional floatation element according to claim 5, wherein said connection means includes a plurality of horizontally projecting tabs, said plurality of horizontally projecting tabs each including at least one aperture therethrough, said aperture constructed and arranged to cooperate with at least one horizontally projecting tab of an adjacent flotation element.

9. The multidirectional floatation element according to claim 8, wherein said horizontally projecting tabs extend generally from intersecting corners of said side walls at different levels for overlapping cooperation with horizontally projecting tabs of adjacent floatation elements.

10. The multidirectional floatation element according to claim 9, wherein said horizontally projecting tabs extending generally from intersecting corners of said side walls at different levels are generally offset closer to said first surface than to said second surface.

11. The multidirectional floatation element according to claim 9, wherein said horizontally projecting tabs extending generally from intersecting corners of said side walls at different levels are generally offset closer to said second surface than to said first surface.

12. The multidirectional floatation element according to claim 1, wherein said two generally parallel and planar surfaces are spaced apart and connected by a generally planar lower surface, said lower surface generally parallel to said first surface.

13. The multidirectional floatation element according to claim 1, wherein said rectangular shape is about 19 inches across.

14. The multidirectional floatation element according to claim 13, wherein said side walls are between about 6 inches in height and about 30 inches in height.

15. The multidirectional floatation element according to claim 1, wherein two of said sidewalls include said semicircular conduits.

16. The multidirectional floatation element according to claim 1, wherein said conduit is adapted for providing a conduit for service utilities through adjacent assembled floatation elements;

whereby said service utilities may be utilized throughout an assembly constructed of said multidirectional floatation elements.

17. In a preexisting floating drive on dry dock assembly, wherein said floating drive on dry dock is constructed of a plurality of generally cubical floatation elements having generally planar uppermost surfaces, wherein the floatation elements are arranged to form two outwardly extending arms with an open well between said two arms, wherein a watercraft is driven longitudinally onto said arms for docking purposes, a kit for filling the open well of said floating drive on dry dock assembly comprising:

at least one multidirectional floatation element, wherein said floatation element is constructed and arranged to fit within said open well between said arms, wherein said at least one multidirectional floatation element is adapted to attach to said floatation elements of said arms, wherein said at least one multidirectional floatation element includes a first generally planar surface, said first surface adapted for use a deck;

a second generally V-shaped surface, said second surface adapted for receiving and guiding a watercraft;

a plurality of side walls for adjoining and maintaining spacing between said first surface and said second surface;

whereby said first surface, said second surface and said plurality of side walls are continuous and cooperate to form a multidirectional floatation element, wherein said multidirectional floatation element includes an aperture through one of said plurality of side walls, said aperture constructed and arranged to allow the addition or subtraction of ballast;

whereby buoyancy of said floatation element is altered by the addition or subtraction of said ballast.

18. The kit for filling the open well of a pre-existing floating drive on dry dock assembly according to claim 17, wherein said kit includes six multidirectional floatation elements wherein said multidirectional floatation elements are constructed and arranged to attach to each other and to said arms of said pre-existing floating drive on dry dock.

19. The kit for filling the open well of a floating drive on dry dock assembly according to claim 17, wherein said floatation element includes a cap constructed and arranged to cooperate with said aperture for maintaining air-tightness within said multidirectional floatation element.

20. The kit for filling the open well of a floating drive on dry dock assembly according to claim 17, wherein said floatation element includes a vented cap constructed and arranged to cooperate with said aperture for allowing air to flow inwardly and outwardly from within said multidirectional floatation element upon a predetermined pressure.

21. The kit for filling the open well of a floating drive on dry dock assembly according to claim 17, wherein said multidirectional floatation element includes connection means, said connection means adapted for linking to at least one adjacent multidirectional flotation element.

22. The kit for filling the open well of a floating drive on dry dock assembly according to claim 21, wherein said connection means is constructed and arranged to link adjacent multidirectional floatation elements together so that the uppermost surfaces of adjacent floatation elements are substantially coplanar.

23. The kit for filling the open well of a floating drive on dry dock assembly according to claim 21 wherein said connection means is constructed and arranged to link adjacent multidirectional floatation elements together so that the uppermost surfaces of adjacent floatation elements are vertically offset to create an upper surface and a lower surface, wherein said upper surface and said lower surface are about parallel with respect to each other.

24. The kit for filling the open well of a floating drive on dry dock assembly according to claim 21, wherein said connection means includes a plurality of horizontally projecting tabs, said plurality of horizontally projecting tabs each including at least one aperture therethrough, said aperture constructed and arranged to cooperate with at least one horizontally projecting tab of an adjacent flotation element.

25. The kit for filling the open well of a floating drive on dry dock assembly according to claim 24, wherein said horizontally projecting tabs extend generally from intersecting corners of said side walls at different levels for overlapping cooperation with horizontally projecting tabs of adjacent floatation elements.

26. The kit for filling the open well of a floating drive on dry dock assembly according to claim 25, wherein said horizontally projecting tabs extending generally from intersecting corners of said side walls at different levels are generally offset closer to said first surface than to said second surface.

27. The kit for filling the open well of a floating drive on dry dock assembly according to claim 25, wherein said horizontally projecting tabs extending generally from intersecting corners of said side walls at different levels are generally offset closer to said second surface than to said first surface.

28. The kit for filling the open well of a floating drive on dry dock assembly according to claim 17, wherein said second surface includes a generally V-shaped channel extending across said multidirectional floatation element, said V-shaped channel including two generally parallel and planar surfaces, said two generally parallel and planar surfaces diverging outwardly to cooperate with a boat keel to provide a guiding surface therefor.

29. The kit for filling the open well of a floating drive on dry dock assembly according to claim 28, wherein said two generally parallel and planar surfaces are spaced apart and connected by a generally planar lower surface, said lower surface generally parallel to said first surface.

30. The kit for filling the open well of a floating drive on dry dock assembly according to claim 17, wherein said floatation element includes four side walls, said side walls arranged to form a generally rectangular shape.

31. The kit for filling the open well of a floating drive on dry dock assembly according to claim 17, wherein said multidirectional floatation element is constructed and arranged for providing service utilities through adjacent assembled floatation elements;

whereby said service utilities may be utilized throughout a floatation element assembly.

* * * * *